United States Patent [19]

Reid

[11] Patent Number: 4,941,968

[45] Date of Patent: Jul. 17, 1990

[54] METHOD FOR INHIBITING GUM FORMATION IN LIQUID HYDROCARBON MEDIUMS

[75] Inventor: Dwight K. Reid, Houston, Tex.

[73] Assignee: Betz Laboratories, Inc., Trevose, Pa.

[21] Appl. No.: 387,329

[22] Filed: Jul. 28, 1989

[51] Int. Cl.[5] ..... C10G 29/20

[52] U.S. Cl. ..... 208/236; 208/213; 208/255; 208/251 H; 208/48 AA; 585/2; 585/648; 585/649; 585/650; 585/950; 44/63

[58] Field of Search ..... 208/213, 255, 251 H, 208/48 AA, 236; 585/648, 649, 650, 950, 2; 44/63

[56] References Cited

U.S. PATENT DOCUMENTS

| | | | |
|---|---|---|---|
| 2,030,033 | 2/1936 | McConnell | 44/63 |
| 2,149,351 | 3/1939 | Lang et al. | 208/255 |
| 2,458,526 | 1/1949 | Oberright | 44/63 |
| 2,530,774 | 11/1950 | Kehe et al. | 44/63 |
| 2,741,578 | 4/1956 | McKinns | 208/255 |
| 3,901,849 | 8/1975 | Dodson et al. | 260/45.8 |
| 4,028,331 | 6/1977 | Hotta et al. | 260/45.8 |
| 4,124,655 | 11/1978 | Koehnlein et al. | 260/878 |
| 4,144,178 | 3/1979 | Katabe et al. | 252/8.7 |
| 4,158,000 | 6/1979 | Nagasaki et al. | 260/45.8 |

*Primary Examiner*—Helane Myers

*Attorney, Agent, or Firm*—Alexander D. Ricci; Bruce E. Peacock

[57] ABSTRACT

Gum and sediment formation in liquid hydrocarbon mediums are inhibited by adding to the medium an alkyl 1,2-dihydroquinoline compound, dimer, trimer or polymer thereof. The invention is particularly well-suited for use in hydrodesulfurizer processes wherein the hydrocarbon medium is typically a naphtha, diesel, kerosene, light gas and or residual fuel charge and the charge or medium is subjected to high temperature and pressure treatment in the presence of a catalyst.

15 Claims, No Drawings

METHOD FOR INHIBITING GUM FORMATION IN LIQUID HYDROCARBON MEDIUMS

FIELD OF THE INVENTION

The present invention pertains to methods for inhibiting gum and sediment formation in liquid hydrocarbon mediums by the addition of alkyl 1,2-dihydroquinoline compounds thereto.

BACKGROUND OF THE INVENTION

In the processing of petroleum hydrocarbons and feedstocks such as petroleum processing intermediates, and petrochemicals and petrochemical intermediates, e.g., gas, oils and reformer stocks, chlorinated hydrocarbons and olefin plant fluids such as deethanizer bottoms, the hydrocarbons are commonly heated to temperatures of 100° to 2000° F., frequently from 600°-1000° F. Similarly, such petroleum hydrocarbons are frequently employed as heating mediums on the "hot side" of heating and heating exchange systems.

During such heat processing, and even during ambient temperature transportation and storage, sediment, sludge and/or gummy masses often form with undesirable results. The so-formed sediment, sludge or gums may cause clogging of equipment or fouling of processing equipment (such as heat exchangers, compressors, furnaces, reactors and distillation systems). Oftentimes, the gummy masses or sediment are catalytically formed by the undesirable presence of metallic impurities such as copper and/or iron that are present in the petroleum hydrocarbon or petrochemical.

In the hydrocarbon processing industry, there are several environments where the need for protection against sediment and gum formation is felt. For example, in a refinery, the crude unit has been the focus of attention, primarily because fuel usage directly impacts on processing costs. Chemical additives have been successfully applied at the heat exchangers, both downstream and upstream from the desalter, on the product side of the preheat train, on both sides of the desalter makeup water exchanger, and at the sour water stripper.

The need to inhibit or minimize gum and sediment formation is also felt in conjunction with unsaturated and saturated gas plants such as refinery vapor recovery units, in catalytic cracker units both at the vacuum unit and at the cracker itself, and in heavy oil treating and cracking units.

One especially troublesome area prone to gum and sediment formation is that of the hydrodesulfurizer (H.D.S.) process. Hydrodesulfurization is designed to improve the qualities of a wide range of petroleum stocks by removing sulfur, nitrogen and heavy metallic contaminants and also to saturate the petroleum stocks with hydrogen. Feedstocks to such units may comprise naphthas, kerosene, fuel oils, diesel fuels and residual fuels.

Common hydrodesulfurization applications include pretreatment of catalytic reforming feedstocks and desulfurization of fuel oils. Reformer feedstocks are processed in a hydrodesulfurizer to remove sulfur, nitrogen and arsenic which are poisonous to the reforming catalyst. Fuel oils are upgraded in a hydrodesulfurizer by removing mercaptans and sulfur which cause foul odors and pollution.

The main steps in a HDS process are: feedstock preheating, catalytic reaction, and product purification. In the preheating stage of the process, feed/effluent exchangers normally heat feedstock from ambient to about 450°-500° F. Hydrogen may be added to the feedstock either prior to the exchangers or after. The degree of vaporization varies depending on temperature, feedstock, pressure, and hydrogen content. During the preheating stage, the reactor heats the feed from the preheat effluent temperature to the reactor inlet temperature of about 650° F.

In the reactor section of the HDS unit, a catalyst, such as a Ni-Mo, Co-Mo, or Ni catalyst is normally held in a fixed bed. Metals are retained by the catalyst without seriously affecting its activity over long periods. Sulfur, nitrogen and oxygen compounds are decomposed to the corresponding hydrocarbon with liberation of $H_2S$, $NH_3$ and water. If organic chlorides are present, HCl is formed.

The following equations illustrate the reactions in the reactor section of an HDS unit $$RSH + H_2 \rightleftharpoons RH + H_2S \quad (1)$$

$$RCl + H_2 \rightleftharpoons RH + HCl \quad (2)$$

$$2RN + 4H_2 \rightleftharpoons 2NH_3 + RH \quad (3)$$

$$ROOH + 2H_2 \rightleftharpoons RH + H_2O \quad (4)$$

Typical operating conditions for the hydrodesulfurization reactions are:

| | |
|---|---|
| Temperature, ° F. | 600-780 |
| Pressure, psig | 600-3000 |
| $H_2$ Recycle rate, SCF/barrel | 1500-3000 |
| Fresh $H_2$ makeup, SCF/barrel | 700-1000 |

In the HDS purification section, cooling water is used to quench the reactor effluent prior to product separation. The separator or flash drum allows the hydrogen, $H_2S$, and $NH_3$ to flash overhead allowing the liquid process hydrocarbon to continue as bottoms. Water can be removed from the separator drum(s) by level control. The stripper or fractionator, as it is sometimes referred to, uses heat to strip off remaining sour gases. The heat source can be in the form of a stripping steam, a thermal syphon reboiler, or a fired reboiler. The stripper bottom leaves the unit as a final effluent, while the overhead vapors go to an amine contactor and the overheat liquids may go to sour water stripping.

HDS units have become an increasingly important part of refinery processes over the last few years. Removal of sulfur and metals from the feedstock affords important protection for the expensive catalysts used in reformers, cat crackers, and hydrocrackers. Also, air quality regulations seeking to lower the allowable sulfur content in airborne emissions coupled with the use of high sulfur content crudes emphasizes the need for such HDS units.

In addition to use to inhibit sediment and gum formation in HDS units, the present invention can be used in pyrogas units wherein higher molecular weight hydrocarbons, such as those in gas oils, are either catalytically cracked or thermally cracked.

Petrochemical systems, like the petroleum refinery systems noted above, also are adversely affected by gum and sediment accumulation in the process fluid.

For example, such problems have been encountered in ethylene and styrene plants. In ethylene plants, furnace gas compressors, fractionating columns and reboilers have all experienced these problems. In butadiene plants, absorption oil fouling and distillation column and reboiler fouling provide troublesome problems that must be overcome to provide process efficiencies.

Accordingly, there is a need in the art to provide for a chemical additive treatment that is adapted to inhibit gum and sediment formation in a liquid hydrocarbonaceous medium. There is also a need for such a treatment that is capable of performing its intended function during the high temperature 100°–2000° F. heat processing of such mediums in accordance with refinery and petrochemical processes. An even more specific need exists for a treatment that is effective in heretofore troublesome processes such as HDS processes, pyrolytic gasoline processes and in butadiene plants.

SUMMARY OF THE INVENTION

The above and other objects of the invention are met by the addition of an alkyl 1,2-dihydroquinoline compound or compounds to the desired liquid hydrocarbonaceous medium. From about 1–10,000 ppm of such compound or compounds is added to the liquid hydrocarbon, with a more preferred range of addition being about 1–1500 ppm based upon one million parts of the liquid hydrocarbon.

As used herein, the phase "liquid hydrocarbonaceous medium" signifies various and sundry petroleum hydrocarbon and petrochemicals. For instance, petroleum hydrocarbons such as petroleum hydrocarbon feedstocks including crude oils and fractions thereof such as naphtha, gasoline, kerosene, diesel, jet fuel, fuel oil, gas oil, vacuum residual, etc., may all be benefitted by using the treatments herein disclosed and claimed.

Similarly, petrochemicals such as olefinic or naphthenic process streams, ethylene glycol, aromatic hydrocarbons and their derivatives may all be successfully treated using the inventive treatments herein described and claimed.

Preferably, the alkyl 1,2-dihydroquinoline compound comprises polymerized 2,2,4-trimethyl-1,2-dihydroquinoline (T.M.D.H.).

PRIOR ART

The compound, 2,2,4-trimethyl-1,2-dihydroquinoline (TMDH) is not new. For instance, in U.S. Pat. No. 4,144,178 (Katabe et al), a polymeric form of the compound is used in combination with certain base oil materials in lubricating compositions that are applied to textile filaments or yarns to aid in spinning, drawing and other textile processes.

Similarly, TMDH monomer, dimer, and polymerization products thereof have been reported as being efficacious rubber antidegradants to prevent natural or synthetic rubbers from flex cracking and heat ageing in U.S. Pat. No. 4,158,000 (Nagasaki et al). The TMDH polymers may also, in accordance with U.S. Pat. No. 4,124,655 (Koehnlein et al), be used in electrical insulating compositions.

In U.S. Pat. No. 4,028,331 (Hotta et al), stabilized polyurethane resin compositions comprising varied hindered phenols and TMDH polymers are taught. The combination is useful in absorbing ultraviolet rays so as to increase the stability of readily degradable polyurethane resins. Table IV, No. 11, of this patent discloses the specific combination of 2,6-di-t-butyl-4-methylphenol and TMDH for such uses. A polymerized TMDH and tetrakismethylene(3,5-di-t-butyl-4-hydroxyhydrocinnamate)]methane combination has similarly been shown to stabilize polyolefin compositions in U.S. Pat. No. 3,901,849 (Dodson et al).

Accordingly, although TMDH has been used in a variety of different applications, it has not, to my knowledge, been utilized to inhibit gum and sediment formation in liquid hydrocarbonaceous mediums. As above stated, there is a need in the art to inhibit same, with an even more specific need existing in the areas of H.D.S., pyrolytic gas manufacture, and butadiene plants.

DETAILED DESCRIPTION OF THE PREFERRED EMBODIMENT

In accordance with the invention, gum and/or sediment formation in liquid hydrocarbonaceous mediums is inhibited by adding to such medium an effective amount for the purpose of an alkyl 1,2-dihydroquinoline compound or polymerized alkyl 1,2-dihydroquinoline. In its monomeric form, the alkyl 1,2-dihydroquinoline compound has the structure

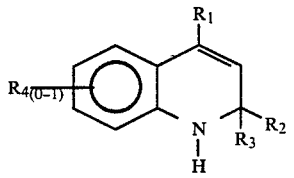

(I)

wherein $R_1$, $R_2$, and $R_3$ are the same or different and are chosen from H, and $C_1$–$C_6$ lower alkyl. $R_4$, when present, is $C_1$–$C_{20}$ alkyl or $C_1$–$C_{10}$ alkoxy.

Exemplary alkyl 1,2-dihydroquinolines include:

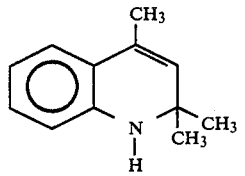

(II)

6-dodecyl-2,2,4-trimethyl-1,2-dihydroquinoline

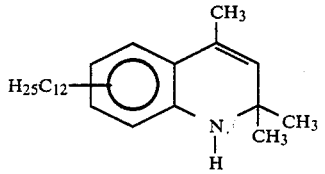

(III)

and 6-ethoxy-2,2,4-trimethyl-1,2-dihydroquinoline

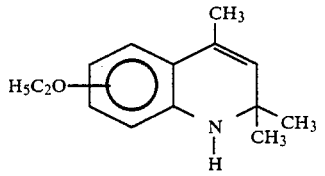

(IV)

Preferred for use is polymerized TMDH having the hypothesized structure (V)

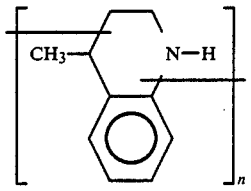

The alkyl 1,2-dihydroquinolines may be present in monomer, dimer, trimer or polymerized form. They are all well known and commercially available.

As reported in U.S. Pat. No. 4,158,000, the alkyl 1,2-dihydroquinolines are produced via reaction between aniline and acetones such as acetone, diacetone alcohol and mesityl oxide in the presence of an acidic catalyst. Mixtures of sundry alkyl 1,2-dihydroquinolines such as TMDH, TMDH dimer, and its polymer forms may be used.

TMDH polymers have been reported as having degrees of polymerization of from about 2 to 5. The polymerized products are light brown or cream colored powders. One such polymer reputedly has a molecular weight of about 500. The polymers are soluble in acetone, ethyl acetate, methylene chloride, carbon tetrachloride, benzene and ethanol and are insoluble in water.

The polymerized TMDH products are available from a plurality of manufacturers and under a host of trademarks. For example, the patent literature indicates availability under the following trademarks: "Flectol H" -Monsanto, "Antigene RD" - Sumitomo Kogaku, "Antiage RD" -Kawaguchi Kagaku, and "Noclarck 224" - Ouchi Shinko Kagaku. The particular TMDH polymer that I have used is available from Borg-Warner under the trademark "Ultranox 254". It is a cream-colored powder having a melting point of 75° C. and a density (20° C.) of 1.08 gm.

The alkyl 1,2-dihydroquinoline compounds or mixtures thereof may be added to the requisite liquid hydrocarbon neat or they may be dissolved in a non-polar solvent such as heavy aromatic naphtha, xylene, etc.

The treatment of the present invention is especially well suited to inhibit gums and sediments that may be formed during HDS processes. As such, the treatment can be added directly to the HDS feedstock prior to preheating thereof, or can be added to the preheater itself or to the H.D.S. reactor. The treatment is especially well adapted to operate under the temperature (e.g., 450°–780° F.) and pressure (e.g., 600–3000 psig.) conditions normally encountered in such H.D.S. processes.

Based upon my present observation, it is preferred to dissolve TMDH polymer in an organic, nonpolar solvent such as H.A.N.

EXAMPLES

The invention will now be further described with reference to the following specific example, which is to be regarded solely as illustrative and not as restricting the scope of the invention.

In order to demonstrate the efficacy of the invention in inhibiting gum and sediment formation in liquid hydrocarbonaceous mediums, polymerized 2,2,4-trimethyl-1,2 dihydroquinoline was added to a jet fuel sample. A control sample as well as a comparative example utilizing the well-known antioxidant, N-phenyl-N'-(1,4-dimethylpentyl)-p-phenylenediamine, were also prepared.

1. The samples were then refluxed for six hours at 365° F. Afterwards, the sample was filtered through a glass fiber filter using a millipore funnel. The filter was washed with heptane in order to collect the precipitate. The precipitate-heptane mixture was then dried in an oven at 110° C. and was allowed to cool for 30 minutes. The resulting precipitate was then weighed.

2. The filtrate from step #1 was transferred to preweighed beakers and was evaporated using ASTM standard D2274-74 in order to determine the amount of insoluble matter therein.

The amount of precipitate from both steps (1) and (2) is then added together with a final precipitate value being the sum of those two figures. Results are shown in the following table.

TABLE

| Sample | Anti-gumming Additive (ppm active) | Total Sediment & Gum Precipitated |
|---|---|---|
| Control | — | 29 6 mg |
| Polymerized TMDH | 75 | 16.0 |
| PDP | 75 | 18.0 |

PDP = N-phenyl-N'-(1,4-dimethylpentyl)-p-phenylenediamine

DISCUSSION

The above results indicate that polymerized TMDH is even more effective than the well-known PDP material in inhibiting sediment and gum formation in a liquid hydrocarbonaceous medium when same has been treated at high temperatures.

While this invention has been described with respect to particular embodiments thereof, it is apparent that numerous other forms and modifications of the invention will be obvious to those skilled in the art. The appended claims and this invention generally should be construed to cover all such obvious forms and modifications thereof which are within the true spirit and scope of the present invention.

What is claimed is:

1. A method of inhibiting the formation of gum and sediment in a liquid hydrocarbonaceous medium comprising adding to said medium an inhibiting amount of an alkyl 1,2-dihdroquinoline or polymerized alkyl 1,2-dihydroquinoline, said alkyl 1, 2-dihydroquinoline having the structure

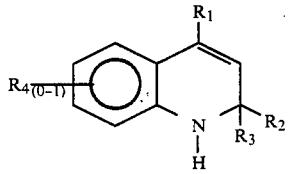

wherein $R_1$, $R_2$, and $R_3$ are the same or different and are chosen form H and $C_1$–$C_6$ alkyl, $R_4$, when present, is $C_1$–$C_{20}$ alkyl, or $C_1$–$C_{10}$ alkoxy.

2. A method as recited in claim 1 wherein said alkyl 1,2-dihydroquinoline compound comprises polymeric 2,2,4-trimethyl-1,2-dihydroquinoline (T.M.D.H.).

3. A method as recited in claim 2 wherein said TMDH is added in an amount of about 1.0 part to about 10,000 parts per million parts of said liquid hydrocarbonaceous medium.

4. A method as recited in claim 3 wherein said TMDH is added in an amount of from 1.0 part to about 1500 parts per million of said liquid hydrocarbonaceous medium.

5. A method as recited in claim 2, wherein said liquid hydrocarbonaceous medium is heated at elevated temperatures.

6. A method as recited in claim 5 wherein said heating is conducted at temperatures of about 100° F.–2000° F.

7. A method as recited in claim 6 wherein said heating is conducted at temperatures of about 600° F.–1000° F.

8. A method as recited in claim 1 wherein said alkyl 1,2-dihydroquinoline or polymerized alkyl 1,2-dihydroquinoline is dissolved in an organic, non-polar solvent.

9. A method as recited in claim 1 wherein said hydrocarbonaceous medium comprises a butadiene process liquid.

10. A method as recited in claim 1 wherein said hydrocarbonaceous medium comprises feedstock to a pyrolytic gasoline process.

11. In a hydrodesulfurization process wherein sulfur and undesirable metal contaminants content of a liquid hydrocarbonaceous medium are reduced by heat treatment and pressurized catalytic reaction, the improvement comprising inhibiting gum and sediment formation in said liquid hydrocarbonaceous medium by adding to said medium an inhibiting amount of an alkyl 1,2-dihydroquinoline or polymerized alkyl 1,2-dihydroquinoline, said alkyl 1,2-dihydroquinoline having the structure

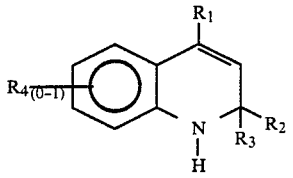

wherein $R_1$, $R_2$ and $R_3$ are the same or different and are chosen form H and $C_1$–$C_6$ lower alkyl, $R_4$, when present, is $C_1$–$C_{20}$ alkyl, or $C_1$–$C_{10}$ alkoxy.

12. A process as recited in claim 11 wherein in said hydrodesulfurization process, said medium is heated to temperatures of about 450°–780° F. and is subjected to pressure of about 600–3000 psig.

13. A process as recited in claim 12 wherein said medium comprises a member selected from the group consisting of naphtha, diesel, kerosene, and light gas oils.

14. A process as recited in claim 12 wherein said alkyl 1,2-dihydroquinoline comprises polymeric 2,2,4-trimethyl-1,2-dihydroquinoline (T.M.D.H.).

15. A method as recited in claim 14 wherein said TMDH is added in an amount of about 1.0 part to about 10,000 parts per million parts of said medium.

* * * * *